US009458840B2

(12) United States Patent
Azuma et al.

(10) Patent No.: US 9,458,840 B2
(45) Date of Patent: Oct. 4, 2016

(54) RELIEF PRESSURE CONTROL DEVICE FOR HYDRAULIC WORK MACHINE

(75) Inventors: Hiroyuki Azuma, Tsuchiura (JP); Tsuyoshi Nakamura, Tsuchiura (JP); Hidenobu Tsukada, Tsuchiura (JP); Kensuke Sato, Tsuchiura (JP); Yasuo Okano, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 552 days.

(21) Appl. No.: 13/994,481

(22) PCT Filed: Dec. 7, 2011

(86) PCT No.: PCT/JP2011/078291

§ 371 (c)(1),
(2), (4) Date: Jun. 14, 2013

(87) PCT Pub. No.: WO2012/086415

PCT Pub. Date: Jun. 28, 2012

(65) Prior Publication Data

US 2013/0263587 A1 Oct. 10, 2013

(30) Foreign Application Priority Data

Dec. 22, 2010 (JP) ..... 2010-286227

(51) Int. Cl.
*E02F 9/22* (2006.01)
*F04B 7/00* (2006.01)
*F15B 13/044* (2006.01)

(52) U.S. Cl.
CPC ..... *F04B 7/00* (2013.01); *E02F 9/2235* (2013.01); *E02F 9/2282* (2013.01); *E02F 9/2285* (2013.01); *E02F 9/2296* (2013.01); *F15B 13/044* (2013.01)

(58) Field of Classification Search
CPC ..... F04B 7/00; F15B 13/044; F15B 11/003; E02F 9/2235; E02F 9/2282; E02F 9/2296; E02F 9/2285
USPC ..... 60/468; 91/445
See application file for complete search history.

(56) References Cited

U.S. PATENT DOCUMENTS 7,387,061 B2 * 6/2008 Kobata ..... F15B 11/048 60/461
2008/0296522 A1 * 12/2008 Yamashita ..... E02F 3/965 251/65
2009/0045361 A1 * 2/2009 Nolle ..... F15B 13/086 251/12

FOREIGN PATENT DOCUMENTS

JP 60-234107 A 11/1985
JP 63-251699 A 10/1988
JP 4-49336 A 2/1992
JP 9-229006 A 9/1997
JP 4458083 B2 4/2010

OTHER PUBLICATIONS

International Search Report dated Jan. 10, 2012 with English translation (four (4) pages).

* cited by examiner

*Primary Examiner* — Michael Leslie
*Assistant Examiner* — Dustin T Nguyen
(74) *Attorney, Agent, or Firm* — Crowell & Moring LLP

(57) ABSTRACT

A relief pressure control system is provided with a controller for outputting, responsive to an adjustment signal output from a dial switch, a control signal to control a relief pressure of a variable solenoid relief valve, a display unit for displaying, responsive to display signals outputted from the controller, a relationship between a circuit pressure output from a pressure sensor and a pressure required by a hydraulic cylinder, and a control device constituting a start instruction unit for instructing a start of control of the variable solenoid relief valve. Stop valves are arranged in sections of main lines, which communicate a directional control valve and the hydraulic cylinder with each other, to open or close the section. The sections are located between positions on the main lines, where the variable solenoid relief valves are connected to the main lines, respectively, and the hydraulic cylinder.

5 Claims, 5 Drawing Sheets

RELIEF PRESSURE CONTROL DEVICE FOR HYDRAULIC WORK MACHINE

TECHNICAL FIELD

This invention relates to a relief pressure control system for a hydraulic working machine having a variable solenoid relief valve, which specifies a maximum circuit pressure, together with working equipment such as a working attachment, e.g., a crusher or breaker or a working mechanism including a boom and arm. The relief pressure control system is suited for arrangement on the hydraulic working machine to control a relief pressure of the variable solenoid relief valve.

BACKGROUND ART

As a conventional technology of this type, there is one disclosed in Patent Document 1. A hydraulic working machine according to this conventional technology is provided with working equipment comprised of a crusher or vibratory breaker, a hydraulic actuator for driving the working equipment, said hydraulic actuator being comprised of a crusher cylinder or breaker cylinder, and a variable displacement hydraulic pump for feeding pressure oil to actuate the hydraulic actuator. This hydraulic working machine is also provided with a directional control valve for controlling a flow of pressure oil to be fed from the variable displacement hydraulic pump to the hydraulic actuator, a control device for switchingly operating the directional control valve, a pilot pump for feeding a pilot pressure to switch the directional control valve, and a variable solenoid relief valve arranged between the directional control valve and the hydraulic actuator to specify a maximum circuit pressure.

On the other hand, a conventional relief control system, which is arranged on the above-mentioned hydraulic working machine to control the relief pressure of the variable solenoid relief valve, is provided with a pressure sensor for detecting a circuit pressure, an adjustment unit for performing an adjustment such that a circuit pressure to be outputted from the pressure sensor becomes equal to a pressure required by the hydraulic actuator for driving the desired working equipment, and a controller for outputting, responsive to a control signal outputted from the adjustment unit, a control signal to control the relief pressure of the variable solenoid relief valve. This conventional relief pressure control system is also provided with a display unit for displaying, responsive to display signals outputted from the controller, a relationship between the circuit pressure outputted from the pressure sensor and the pressure required by the hydraulic actuator, and a start instruction unit for instructing a start of control of the variable solenoid relief valve.

The working equipment comprised of the crusher or breaker is mounted, and this conventional relief pressure control system performs control of the relief pressure of the variable solenoid relief valve while actuating the working equipment.

PRIOR ART DOCUMENT

Patent Document

Patent Document 1: JP-B-4458083

DISCLOSURE OF THE INVENTION

Problem to be Solved by the Invention

The above-mentioned conventional technology disclosed in Patent Document 1 performs the control of the relief pressure while actuating the working equipment, and therefore, is apprehensive of failing to adjust to a proper pressure as designed for the hydraulic actuator that drives the working equipment. Described specifically, a surge pressure may arise when the working equipment is actuated. When such a surge pressure arises, the display unit displays the surge pressure as a maximum circuit pressure. In such a case, it, therefore, becomes impossible to adjust to the proper pressure as designed. When the working mechanism is operated, the pressure tends to fluctuate under the effect of a control direction or an object under work. By such fluctuations, it also becomes impossible to adjust to the proper pressure as designed.

It is to be noted that in the technology disclosed in Patent Document 1, the working equipment is limited to a crusher or breaker. Working equipment, which may be arranged on a hydraulic working machine provided with a variable solenoid relief valve, is not limited only to a crusher or breaker, but also includes various working equipment such as working mechanisms having a boom and arm, rotary working attachments, and a gripper. With the above-mentioned conventional technology disclosed in Patent Document 1, it is impossible to realize control of the relief pressure of a variable solenoid relief valve arranged on a hydraulic working machine provided with working equipment other than a crusher or breaker.

With the above-mentioned actual situation in view, the present invention has as an object thereof the provision of a relief pressure control system for a hydraulic working machine, which can realize control of the relief pressure of a variable solenoid relief valve without actuation of working equipment.

Means for Solving the Problem

To achieve this object, the present invention is characterized in that, in a relief pressure control system for a hydraulic working machine having working equipment, a hydraulic actuator for driving the working equipment, a variable displacement hydraulic pump for feeding pressure oil to actuate the hydraulic actuator, a directional control valve for controlling a flow of pressure oil to be fed from the variable displacement hydraulic pump to the hydraulic actuator, a control device for switchingly operating the directional control valve, a pilot pump for feeding a pilot pressure to switch the directional control valve, and a variable solenoid relief valve arranged between the directional control valve and the hydraulic actuator to specify a maximum circuit pressure, said relief pressure control system being provided with a pressure sensor for detecting a circuit pressure, a pressure adjuster for performing an adjustment such that a circuit pressure to be outputted from the pressure sensor becomes equal to a pressure required by the hydraulic actuator, a controller for outputting, responsive to an adjustment signal outputted from the pressure adjuster, a control signal to control a relief pressure of the variable solenoid relief valve, a display unit for displaying, responsive to display signals outputted from the controller, a relationship between the circuit pressure outputted from the pressure sensor and the pressure required by the hydraulic actuator, and a start instruction unit for instructing a start of control of the variable solenoid relief valve, a stop valve is arranged in a section of a main line, which communicates the directional control valve and the hydraulic actuator with each other, to open or close the section, said section being located between a position on the main line, where the variable solenoid relief valve is connected to the main line, and the hydraulic actuator.

The present invention constructed as described above performs the control of a relief pressure as will be described hereinafter. Described specifically, for example, the stop valve is actuated to remain in a closed position upon controlling the relief pressure. As a consequence, the line that communicates the directional control valve and the hydraulic actuator with each other is closed. In this state, pressure oil is delivered from the variable displacement hydraulic pump at a flow rate that corresponds to a flow rate required for the hydraulic actuator to actuate the desired working equipment, and the directional control valve is switchingly operated further. As a consequence, the pressure oil delivered at the flow rate from the variable displacement hydraulic pump is fed via the directional control valve to the section of the line that communicates the directional control valve and the stop valve with each other, and therefore, a pressure arises in the section of the line. This pressure is detected by the pressure sensor, is outputted as a circuit pressure to the controller, and is then shown at the display unit by a display signal from the controller. An adjustment is now performed by the pressure adjuster, for example, such that a circuit pressure to be displayed at the display unit becomes equal to a proper pressure required by the hydraulic actuator as designed, and responsive to an adjustment signal outputted from the pressure adjuster, a control signal is outputted from the controller to the variable solenoid relief valve to control the relief pressure. As a consequence, the relief pressure of the variable solenoid relief valve can be adjusted to the pressure as designed.

In the present invention, the working equipment may be kept in either a mounted position or a dismounted position while such control, in other words, adjustment of the relief pressure is performed. Whichever position the working equipment is kept in, pressure oil is not fed to the hydraulic actuator in the present invention because the section of the line to the hydraulic actuator is closed by the stop valve. In other words, the present invention can adjust the relief pressure of the variable solenoid relief valve to a relief pressure, which is commensurate with driving of the hydraulic cylinder for the desired working equipment, without actuation of the working equipment. It is, therefore, possible to adjust to the relief pressure as designed without being affected by a surge pressure that arises upon operation of the working equipment is actuated and also without being affected by fluctuations in pressure that occur when the working equipment is actuated. It is to be noted that the present invention can be applied to any hydraulic working machine insofar as it is provided with a variable solenoid relief valve. Described specifically, the present invention can be applied not only to a hydraulic working machine provided with working equipment comprised of a crusher or breaker but also to a working machine provided with working equipment including a boom and arm.

The present invention may also be characterized in that in the above-described invention, the stop valve comprises a manually-operated valve.

The present invention may also be characterized in that in the above-described invention, the stop valve comprises a solenoid valve that is actuated responsive to a control signal outputted from the controller.

The present invention may also be characterized in that in the above-described invention, the control device comprises an electric control device that outputs to the controller an electrical signal corresponding to an amount of manipulation of the control device, the pressure adjuster comprises an adjustment unit included in the controller, the relief pressure control system is provided with a proportional solenoid valve, which is arranged between a control port of the directional control valve and the pilot pump and is controllable by a control signal outputted from the controller responsive to a control signal outputted from the electrical control device, and the controller comprises one that, when a start of control of the relief pressure is instructed by the start instruction unit, outputs a signal to maintain in a closed position the stop valve that comprises the solenoid valve, outputs a signal to actuate the proportional solenoid valve, and makes the pressure adjuster output an adjustment signal to control the variable solenoid relief valve.

The present invention constructed as described above automatically performs the control of a relief pressure upon receipt of an instruction for starting the control of the relief pressure from the start instruction unit. It is, therefore, possible to easily adjust, for example, to a relief pressure as designed by simply manipulating the start instruction unit.

The present invention may also be characterized in that in the above-described invention, the control device comprises a direct acting control device connected to control ports of the directional control valve.

Advantageous Effects of the Invention

The present invention is configured to be provided with the stop valve, which as mentioned above, is arranged between the variable solenoid relief valve for specifying a maximum circuit pressure and the hydraulic actuator for driving the working equipment, and opens or closes the line that communicates the variable solenoid relief valve and the hydraulic actuator with each other. Owing to this configuration, the control of the relief pressure of the variable solenoid relief valve can be realized without actuation of the working equipment. Without being affected by a surge pressure conventionally occurred upon actuation of the working equipment or by pressure fluctuations conventionally occurred in association with actuation of the working equipment, it is, therefore, possible to adjust, for example, to a relief pressure as designed, so that the adjustment of the relief pressure can be realized with high accuracy compared with before. Further, the present invention can be applied to hydraulic working machines having various working equipment, including working equipment comprised of a crusher or breaker as before.

MODES FOR CARRYING OUT THE INVENTION

Embodiments of the relief pressure control system according to the present invention for a hydraulic working machine will hereinafter be described based on the drawings.

Figure 1:
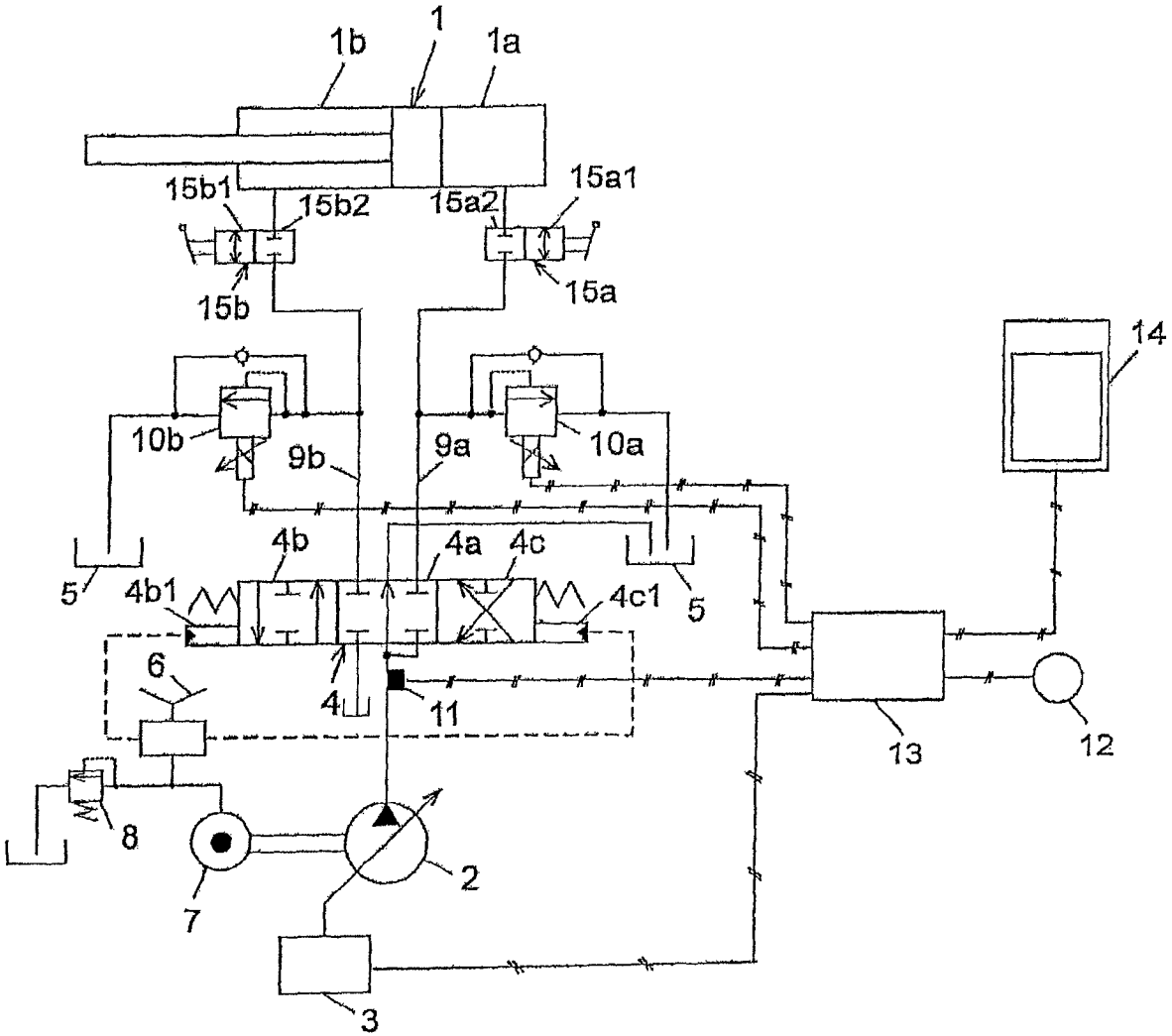
FIG. 1 is an electrical and hydraulic diagram showing a first embodiment of the relief pressure control system according to the present invention for a hydraulic working machine.
Figure 2:
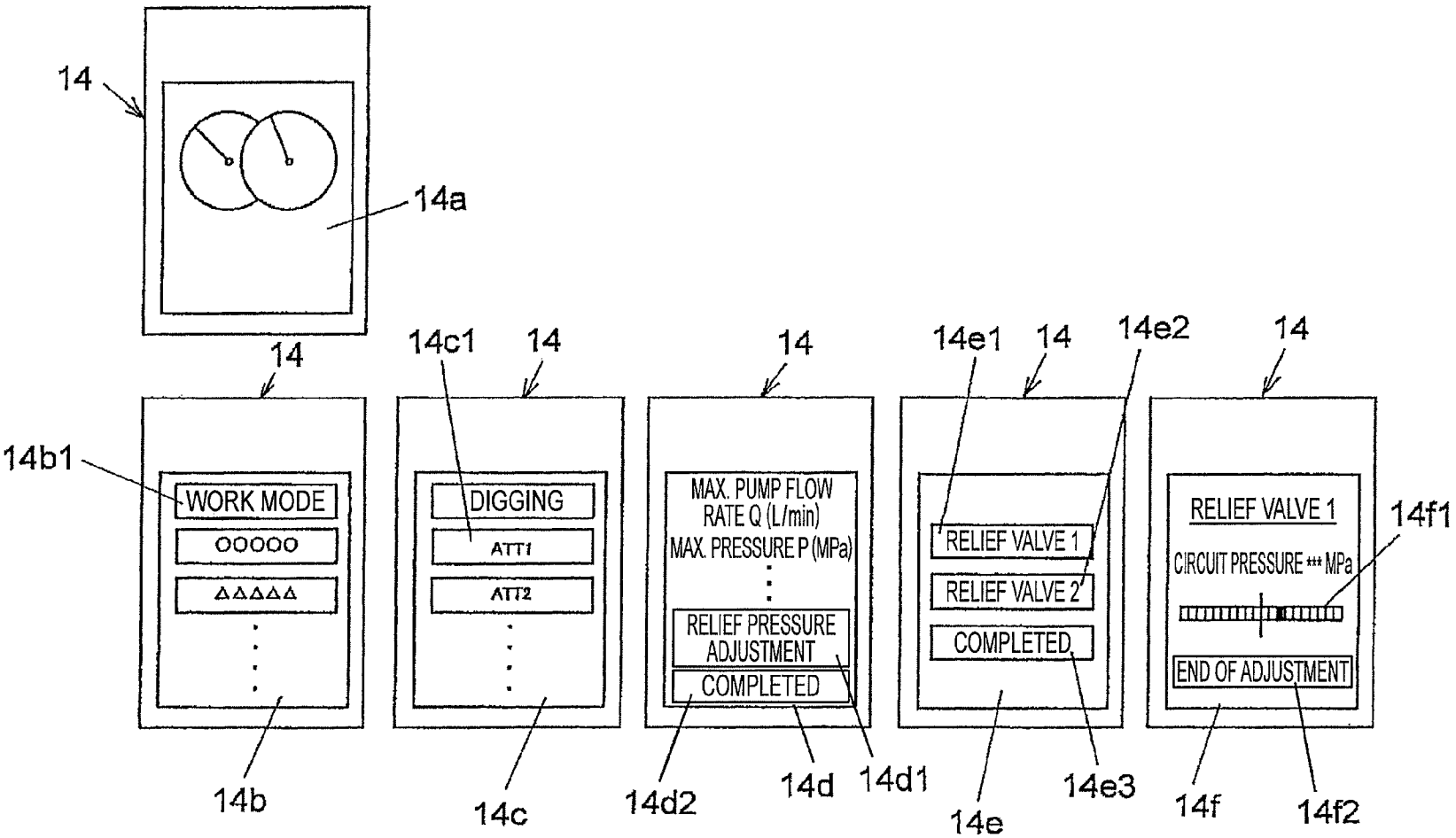
FIG. 2 is a diagram depicting screens of a display unit arranged in the first embodiment.

FIG. 1 is an electrical and hydraulic diagram showing a first embodiment of the relief pressure control system according to the present invention for the hydraulic working machine, and FIG. 2 is a diagram depicting screens of a display unit arranged in the first embodiment.

The hydraulic working machine on which the relief pressure control system according to this embodiment is arranged can be a hydraulic working machine provided with working equipment such as a working attachment, e.g., a crusher or breaker or a working mechanism including a boom and arm, and as shown in FIG. 1, is provided with a hydraulic actuator for driving the desired working equipment, for example, a hydraulic cylinder 1, a variable displacement hydraulic pump 2 for feeding pressure oil to actuate the hydraulic cylinder 1, and a solenoid-operated regulator 3 for controlling the delivery rate of the variable displacement hydraulic pump 2.

This hydraulic working machine is provided with a directional control valve 4 for controlling a flow of pressure oil to be fed from the variable displacement hydraulic pump 2 to the hydraulic cylinder 1, a reservoir 5 connected to the directional control valve 4, a control device 6 for switchingly operating the directional control valve 4, a pilot pump 7 for feeding a pilot pressure to switch the directional control valve 4, and a pilot relief valve 8 for specifying a maximum pilot pressure to be delivered from the pilot pump 7. The above mentioned directional control valve 4 has a neutral position 4*a*, and a left position 4*b* and right position 4*c* as positions switched from the neutral position 4*a*. Further, the above-mentioned control device 6 is comprised, for example, of a direct acting control device connected to control ports 4*b*1, 4*c*1 of the directional control valve 4 via pilot lines which can be brought into communication with the pilot pump 7.

The directional control valve 4 and a bottom chamber 1*a* of the hydraulic cylinder 1 are connected to each other via a main line 9*a*, and the directional control valve 4 and a rod chamber 1*b* of the hydraulic cylinder 1 are connected to each other via a main line 9*b*. A first variable solenoid relief valve 10*a* is arranged in the main line 9*a*, and a second variable solenoid relief valve 10*b* is arranged in the main line 9*b*. These variable solenoid relief valves 10*a*, 10*b* specify a maximum circuit pressure.

As also shown in FIG. 1, the relief pressure control system according to this embodiment, which is arranged on such a hydraulic working machine, is provided with a pressure sensor 11 for detecting a circuit pressure, and an adjustment unit for performing an adjustment such that a circuit pressure to be outputted from the pressure sensor 11 becomes equal to a pressure required by the hydraulic cylinder 1, e.g., the pressure as designed, for example, a dial switch 12 that can be press-operated and also rotation-operated. Also provided are a controller 13 for outputting, responsive to an adjustment signal outputted from the dial switch 12, a control signal to control the relief pressure of the variable solenoid valve 10*a*, 10*b* and a display unit 14 for displaying, responsive to display signals outputted from the controller 13, a relationship between the circuit pressure outputted from the pressure sensor 11 and the pressure required by the hydraulic cylinder 1. Upon adjustment of the relief pressure of the variable solenoid relief valve 10*a*, 10*b*, the dial switch 12 is press-operated or rotation-operated while performing screen handling by watching the screen of the display unit 14 as will be described subsequently herein.

This embodiment is also provided with two stop valves. Each stop valve is arranged in a section of the corresponding main line, which communicates the directional control valve 4 and the hydraulic cylinder 1 with each other, to open or close the section of the main line. This section of the main line is located between a position on the main line, where the corresponding variable solenoid relief valve is connected to the main line, and the hydraulic cylinder 1. For example, a first stop valve 15*a* having an open position 15*a*1 and closed position 15*a*2 is arranged in a section of the main line 9*a* communicating the directional control valve 4 and the bottom chamber 1*a* of the hydraulic cylinder 1 to each other, said section being downstream of a position on the main line 9*a*, where the first variable solenoid relief valve 10*a* is connected to the main line 9*a*. In addition, a second stop valve 15*b* having an open position 15*b*1 and closed position 15*b*2 is arranged in a section of the main line 9*b* communicating the directional control valve 4 and the rod chamber 1*b* of the hydraulic cylinder 1 to each other, said section being downstream of a position on the main line 9*b*, where the second variable solenoid relief valve 10*b* is connected to the main line 9*b*. These first stop valve 15*a* and second stop valve 15*b* are comprised, for example, of manually-operated valves, respectively. It is to be noted that in this first embodiment, the above-mentioned control device 6 constitutes a start instruction unit that instructs starts of control of the variable solenoid relief valves 10*a*, 10*b*.

In the relief pressure control system according to this embodiment, the control, in other words, adjustment of the relief pressure of each of the variable solenoid relief valves 10*a*, 10*b* is performed as will be described hereinafter. It is to be noted that the term "adjustment" as described above includes both an adjustment for performing initial setting upon starting first use of the working equipment and an adjustment for changing or correcting a relief pressure which has been already set.

Upon adjustment of a relief pressure, the first stop valve 15*a* and second stop valve 15*b* are manually operated to switch them to the closed positions 15*a*2, 15*b*2, respectively. As a result, the feeding of pressure oil to the bottom chamber 1*a* or rod chamber 1*b* of the hydraulic cylinder 1 and the return operation of oil from the rod chamber 1*b* or bottom chamber 1*a* to the reservoir 5 are inhibited.

While watching the display unit 14 under the above-described conditions, screen handling and a press-operation of the dial switch 12 are performed. Described specifically, the dial switch 12 is pressed once from the state of an initial selection screen 14*a* depicted in FIG. 2, the screen of the display unit 14 then changes to a mode selection screen 14*b*. "Work Mode" 14*b*1 on the mode selection screen 14*b* is next specified by touching it with a finger tip or the like and the dial switch 12 is pressed once, the screen of the display unit 14 then changes to a desired equipment selection screen 14*c*. "Attachment 1 (ATT1)", which indicates the type of desired equipment, on the desired equipment selection screen 14*c* is specified by touching it with a finger tip or the like and the dial switch 12 is pressed once, the screen of the display unit 14 then changes to an adjustment item selection screen 14*d*. "Relief Pressure Adjustment" 14*d*1 on the adjustment item selection screen 14*d* is pressed once, the screen of the display unit 14 then changes to an adjustment target valve selection screen 14*e*.

Now, the "Relief Pressure Adjustment" 14*d*1 is pressed as mentioned above, for example. A control signal is then outputted from the controller 13 to control the regulator 3 such that the delivery rate of the variable displacement hydraulic pump 2 becomes equal to a flow rate required by the hydraulic cylinder 1 for driving the desired working equipment, in other words, the flow rate as designed. As a result, pressure oil is delivered from the variable displacement hydraulic pump 2 at a flow rate commensurate with the flow rate required by the hydraulic pump 1.

From such a state as described above, for example, "Relief Valve 1" 14*e*1, which corresponds to the first variable solenoid relief valve 10*a*, on the adjustment target valve selection screen 14*e* depicted in FIG. 2 is specified by touching it with a finger tip or the like, and the dial switch 12 is pressed once. The screen of the display unit 14 then changes to an adjustment execution screen 14*f*.

With the adjustment execution screen 14*f* being displayed on the display unit 14 as described above, the control device 6 is switchingly manipulated to a maximum amount of manipulation such that a pilot pressure is delivered from the pilot pump 7 to, for example, the control port 4*b*1 of the directional control valve 4 and the directional control valve 4 is switched to the left position 4*b*. Pressure oil delivered from the variable displacement hydraulic pump 2 is then fed to the main line 9*a* via the left position 4*b* of the directional control valve 4. As a result, a maximum circuit pressure arises in the main line 9*a* to which the first variable solenoid relief valve 10*a* is connected. This pressure is detected by the pressure sensor 11, and is outputted as a circuit pressure to the controller 13. Further, responsive to a display signal outputted from the controller 13, the circuit pressure detected by the pressure sensor 11 is displayed, for example, as a rectangular dot on an adjustment bar 14*f*1 on the above-mentioned adjustment execution screen 14*f*.

By rotationally manipulating the dial switch 12 clockwise or counterclockwise in this state while watching a relationship between a graduation line formed at a center of the adjustment bar 14*f*1 and corresponding to the proper pressure based on the design and the circuit pressure detected by the pressure sensor 11, a control signal (current value) to be outputted from the controller 13 to the first variable solenoid relief valve 10*a* is adjusted. During this adjustment of the control signal, the first variable solenoid relief valve 10*a* repeats increase and decrease in opening area so that the circuit pressure in the main line 9*a* decreases or increases. By suitably rotating the dial switch 12 to bring a pressure, which is detected by the pressure sensor 11, into conformity with the graduation line at the center of the adjustment bar 15*f*1, the relief pressure of the first variable solenoid relief valve 10*a* can, therefore, be adjusted such that the pressure in the main line 9*a* communicated to the bottom chamber 1*a* of the hydraulic cylinder 1 becomes equal to the pressure as designed.

With the pressure detected by the pressure sensor 11 being in conformity with the graduation line at the center of the adjustment bar 14*f*1, "End of Adjustment" 14*f*2 is specified by touching it with a finger tip or the like and the dial switch 12 is pressed once. The adjustment of the first variable solenoid relief valve 10*a* is hence ended, and the screen of the display unit returns to the adjustment target valve selection screen 14*e* which is the immediately preceding screen.

Next, "Relief Valve 2" 14*e*2 which corresponds to the second variable solenoid relief valve 10*b* is specified by touching it with a finger tip or the like, and the dial switch 12 is pressed once. The screen of the display unit 14 then changes to an unillustrated adjustment execution screen, which is for the second variable solenoid relief valve 10*b* and is similar to the adjustment execution screen 14*f*.

When the control device 6 is switchingly manipulated to a maximum amount of manipulation in a direction opposite to the above-mentioned direction such that a pilot pressure is fed to the control port 4*c*1 of the directional control valve 4 and the directional control valve 4 is switched to the right position 4*c*, pressure oil delivered from the variable displacement hydraulic pump 2 is fed to the main line 9*b* and a maximum circuit pressure rises in this main line 9*b*. By rotationally manipulating the dial switch 12 to adjust a circuit pressure outputted from the pressure sensor 11 at this time while watching an unillustrated adjustment execution screen for the second variable solenoid relief valve 10*b*, the relief pressure of the second variable solenoid relief valve 10*b* can, therefore, be adjusted like the above-mentioned adjustment of the relief pressure of the first variable solenoid relief valve 10*a* such that the pressure in the main line 9*b* communicated to the rod chamber 1*b* of the hydraulic cylinder 1 becomes equal to the pressure as designed.

With the pressure detected by the pressure sensor 11 being in conformity with the graduation line at the center of the adjustment bar on the unillustrated adjustment execution screen for the second variable solenoid relief valve 10*b*, "End of Adjustment" is specified by touching it with a finger tip or the like and dial switch 12 is pressed once. The adjustment of the second variable solenoid relief valve 10*b* is hence ended, and the screen of the display unit 14 returns to the adjustment target valve selection screen 14*e*. Now, "Completed" 14*e*3 is specified by touching it with a finger tip or the like and the dial switch 12 is pressed once. The display unit 14 then returns to the initial selection screen 14*a*.

For example, the control device 6 is subsequently returned to the neutral position to have the directional control valve 4 returned to the neutral position 4*a*, the first stop valve 15*a* is switched to the open position 15*a*1 to go into a state that the feeding of pressure oil into the bottom chamber 1*a* of the hydraulic cylinder 1 via the main line 9*a* is feasible, and the second stop valve 15*b* is switched to the open position 15*b*1 to go into a state that the feeding of pressure oil into the rod chamber 1*b* of the hydraulic cylinder 1 via the main line 9*b* is feasible. As a result, it has become possible to drive the desired working equipment through the actuation of the hydraulic cylinder 1.

According to the first embodiment constructed as described above, the main lines 9*a*, 9*b* to the bottom chamber 1*a* and rod chamber 1*b* of the hydraulic cylinder 1 are closed by the stop valves 15*a*, 15*b* upon adjustment of the relief pressures of the respective variable solenoid relief valves 10*a*, 10*b*, as mentioned above. Therefore, pressure oil is fed to neither the bottom chamber 1*a* nor the rod chamber 1*b* of the hydraulic cylinder 1. In other words, the control of the relief pressures of the variable solenoid relief valves 10*a*, 10*b* can be performed without actuation of the desired working equipment, and the relief pressures of the variable solenoid relief valves 10*a*, 10*b* can be adjusted to relief pressures commensurate with the driving of the hydraulic cylinders 1 for the desired working equipment. Accordingly, without being affected by a surge pressure occurred upon actuation of the working equipment and without being affected by fluctuations in pressure during the actuation of the working equipment, these relief pressures can be adjusted to the relief pressures as designed so that the high-accuracy adjustment of the relief pressures can be realized.

It is to be noted that this embodiment can be applied to any hydraulic working machine insofar as it is provided with one or more variable solenoid relief valves. Described specifically, this embodiment can be applied to various hydraulic working machines which are each provided with a working attachment such as a crusher or a breaker or a working mechanism including a boom and arm.

Figure 3:
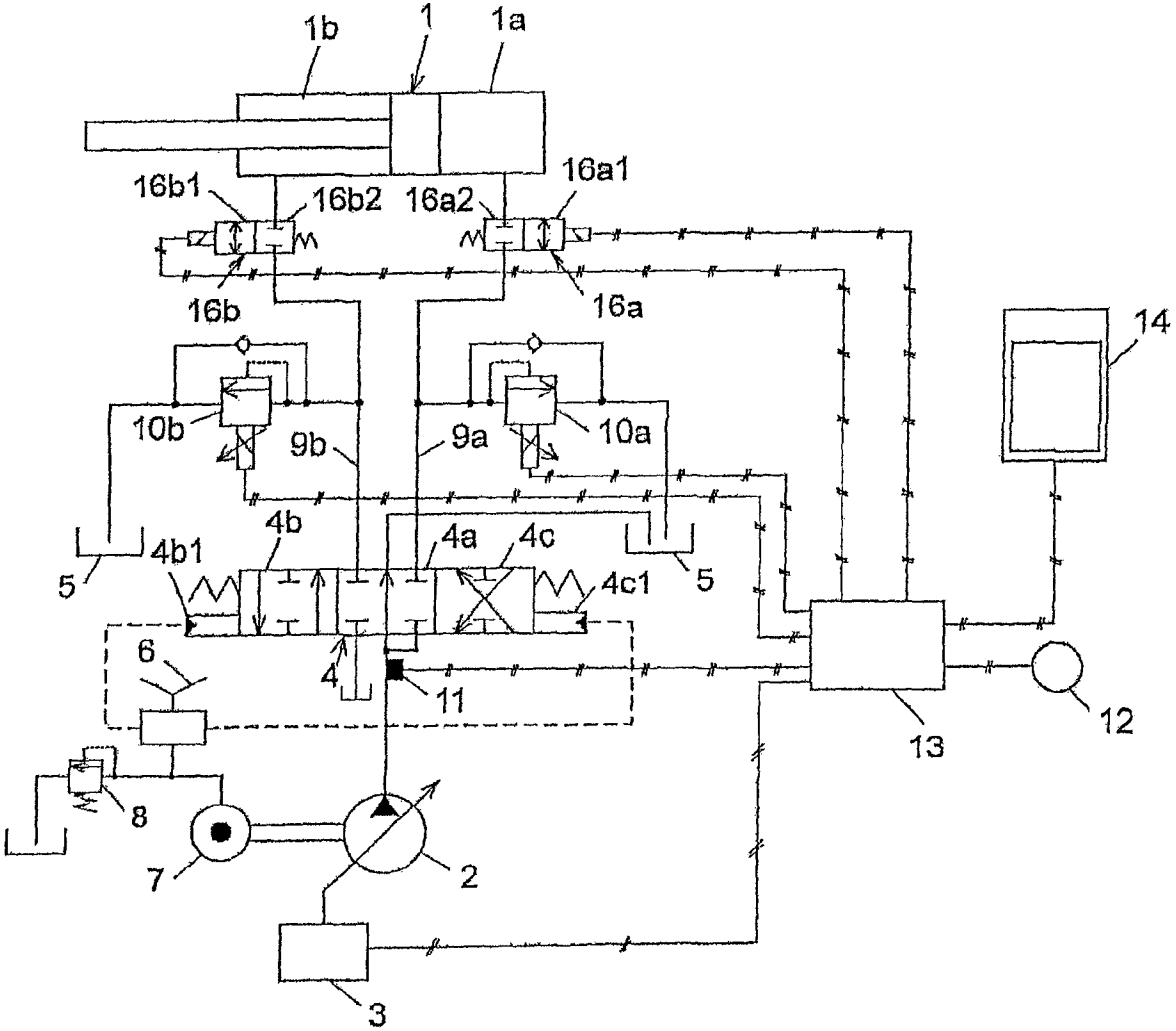
FIG. 3 is an electrical and hydraulic diagram showing a second embodiment of the present invention.

FIG. 3 is an electrical and hydraulic circuit diagram showing a second embodiment of the present invention.

In this second embodiment, a first stop valve 16*a*, which is comprised of a solenoid valve and is actuated responsive to a control signal outputted from the controller 13, is arranged, in place of the manually-operated first stop valve 15*a* in the first embodiment, in a section of the main line 9*a*, said section being located between a position on the main line 9*a*, where the first variable solenoid relief valve 10*a* is connected to the main line 9*a*, and the bottom chamber 1*a* of the hydraulic cylinder 1. Similarly, a second stop valve 16*b*, which is comprised of a solenoid valve and is actuated responsive to a control signal outputted from the controller 13, is arranged, in place of the manually-operated second stop valve 15*b* in the first embodiment, in a section of the main line 9*b*, said section being located between a position on the main line 9*b*, where the second variable solenoid relief valve 10*b* is connected to the main line 9*b*, and the rod chamber 1*b* of the hydraulic cylinder 1. The remaining construction is similar to that of the above-described first embodiment.

The second embodiment constructed as described above can also perform the adjustment of relief pressures as in the first embodiment by press-operations and rotation-operations of the dial switch 12, which are performed while watching the screen of the display unit 14 depicted in FIG. 2. In operations, the second embodiment is different from the first embodiment in the following respects.

Described specifically, upon adjustment of the relief pressures in the first embodiment, the stop valves 15*a*, 15*b*, for example, are first manually operated to switch them to the closed positions 15*a*2, 15*b*2, respectively. In the second embodiment, on the other hand, when the "Relief Valve 1" 14*e*1 on the adjustment target valve selection screen 14*e* is specified and the dial switch 12 is pressed once, for example, a control signal is outputted from the controller 13 to the first stop valve 16*a* to switch the first stop valve 16*a* to a closed position 16*a*2. When the adjustment of the relief pressure of the first variable solenoid relief valve 10*a* is ended, the "End of Adjustment" 14*f*2 on the adjustment execution screen 14*f* is specified and the dial switch 12 is pressed once, a control signal is outputted from the controller 13 to the first stop valve 16*a* to switch the first stop valve 16*a* to an open position 16*a*1. Similarly, when "Relief Valve 1" 14*e*2 on the adjustment target valve selection screen 14*e* is specified and the dial switch 12 is pressed once, a control signal is outputted from the controller 13 to the second stop valve 16*b* to switch the second stop valve 16*b* to a closed position 16*b*2. When the adjustment of the relief pressure of the second variable solenoid relief valve 10*b* is ended, an option corresponding to the "End of Adjustment" 14*f*2 on the adjustment execution screen 14*f* is specified, and the dial switch 13 is pressed once, a control signal is outputted from the controller 13 to the second stop valve 16*b* to switch the second stop valve 16*b* to an open position 16*b*1.

The second embodiment constructed as described above can also realize the adjustment of relief pressures without feeding pressure oil to the bottom chamber 1*a* and rod chamber 1*b* of the hydraulic cylinder 1 by switching the stop valves 16*a*, 16*b* to the closed positions 16*a*2, 16*b*2, respectively, as in the first embodiment. In other words, the control of the relief pressures of the variable solenoid relief valves 10*a*, 10*b* can be realized without actuation of the desired working equipment, and therefore, similar advantageous effects to those of the first embodiment can be obtained. According to this second embodiment, the switching operations of the stop valves 16*a*, 16*b* are automatically performed so that the second embodiment can easily perform the adjustment work of relief pressures compared with the first embodiment.

Figure 4:
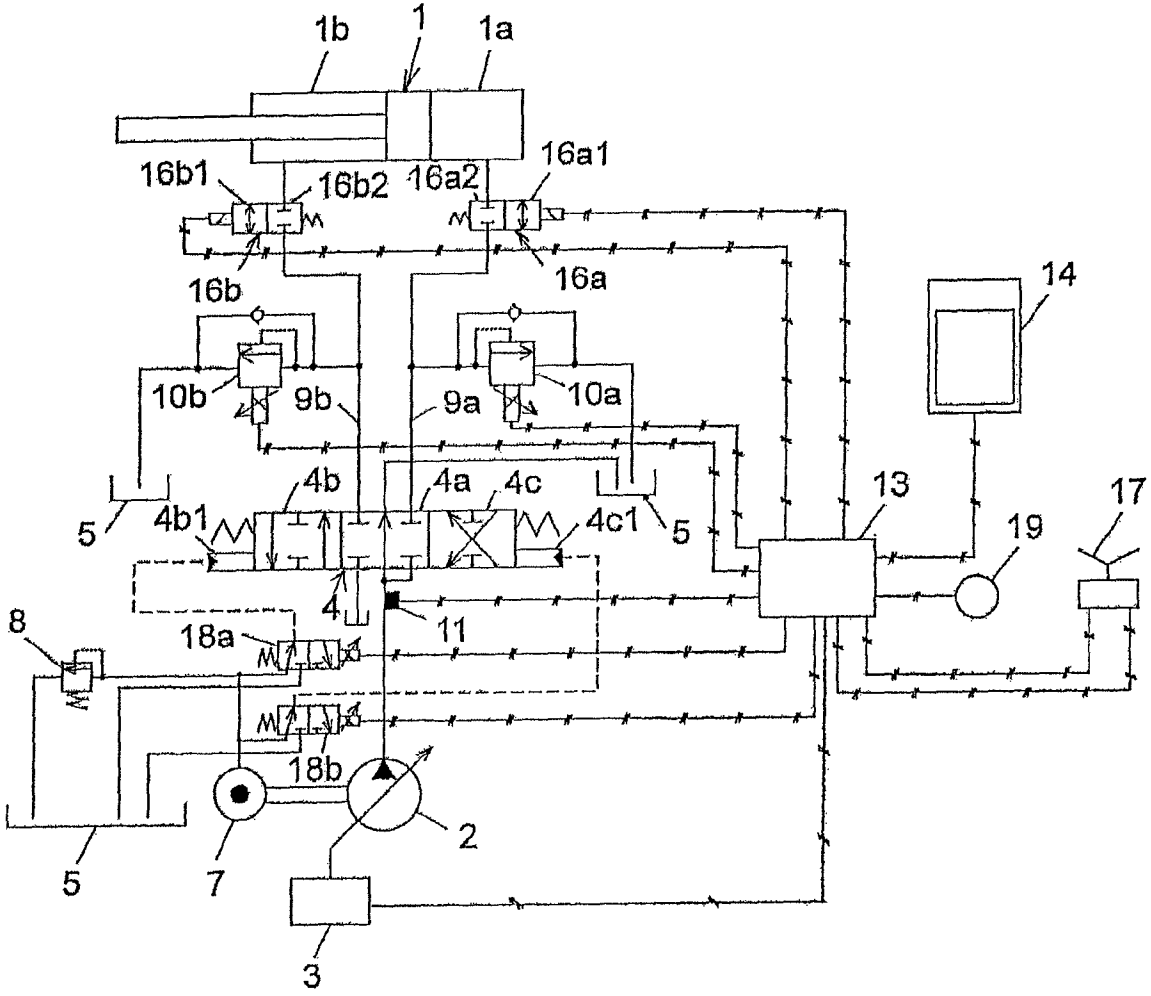
FIG. 4 is an electrical and hydraulic diagram showing a third embodiment of the present invention.
Figure 5:
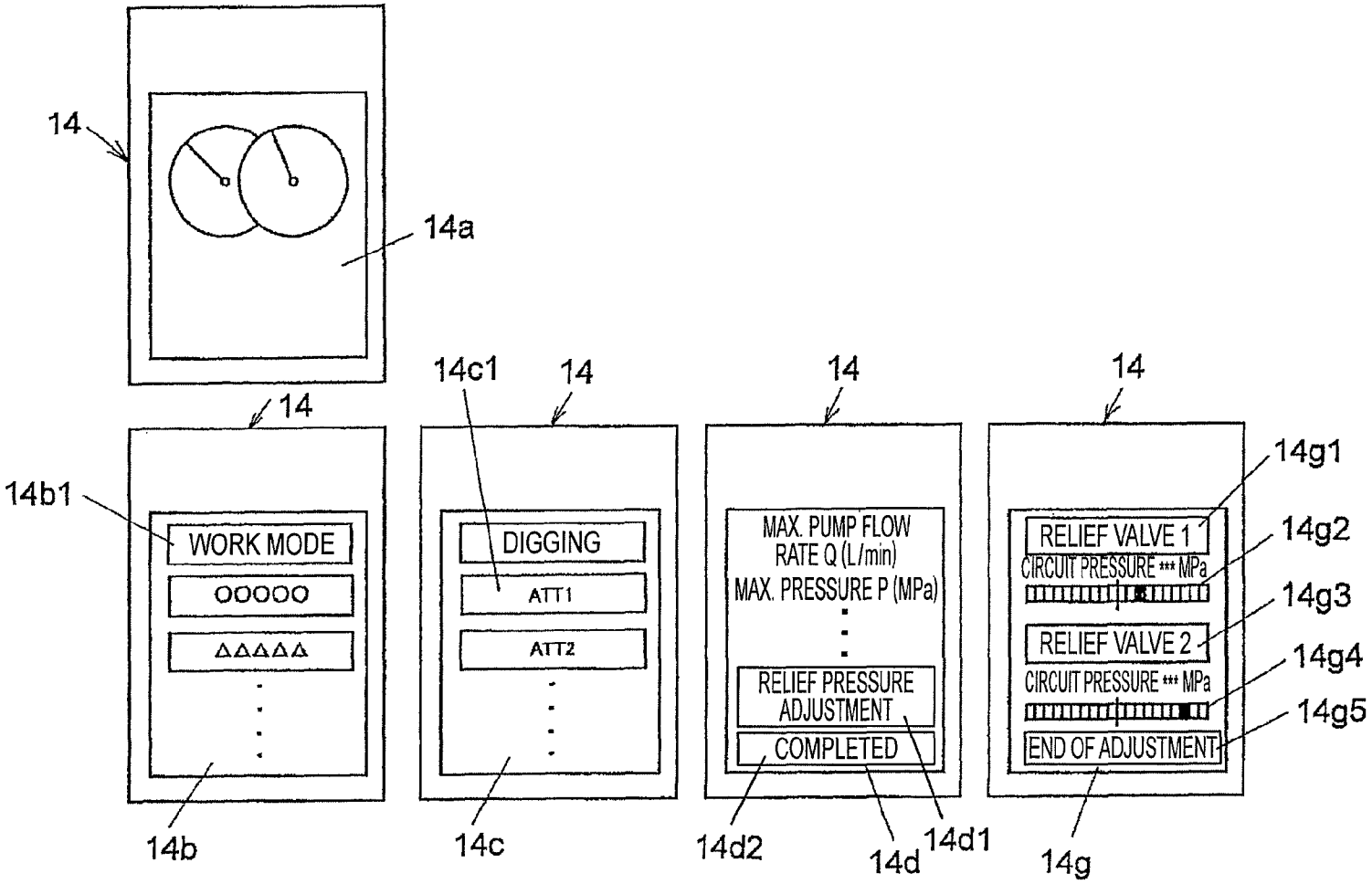
FIG. 5 is a diagram depicting screens of a display unit arranged in the third embodiment.

FIG. 4 is an electrical and hydraulic diagram showing a third embodiment of the present invention, and FIG. 5 is a diagram depicting screens of a display unit arranged in the third embodiment.

In a relief pressure control system according to the third embodiment, a control device 17 is comprised, as shown in FIG. 4, of an electric lever device that outputs to the controller 13 an electrical signal corresponding to an amount of manipulation, specifically a stroke. Further, an adjustment unit, which performs an adjustment such that a circuit pressure outputted from the pressure sensor 11 becomes equal to a pressure required by the hydraulic cylinder 1, for example, the proper pressure as designed, is built in the controller 13. Furthermore, this third embodiment is also provided with a first proportional solenoid valve 18*a* and a second proportional solenoid valve 18*b*. The first proportional solenoid valve 18*a* is arranged between the control port 4*b*1 of the directional control valve 4 and the pilot pump 7, and is controlled by a control signal outputted from the controller 13 responsive to a control signal outputted from the control device 17. The second proportional solenoid valve 18*b* is arranged between the control port 4*c*1 of the directional control valve 4 and the pilot pump 7, and is controlled by a control signal outputted from the controller 13 responsive to a control signal outputted from the control device 7.

In addition, a start switch 19 connected to the controller 13 is also provided as an instruction unit for instructing starts of control of the variable solenoid relief valves 10*a*, 10*b*. The controller 13 is comprised of one that, when the start of control of a relief pressure is instructed by the start switch 19, outputs a signal to maintain the first stop valve 16*a* or second stop valve 16*b* as a solenoid valve in the closed position 16*a*2 or 16*b*2, outputs a signal to actuate the first proportional solenoid valve 18*a* or second proportional solenoid valve 18*b*, and makes the adjustment unit, which is built in the controller 13, output an adjustment signal to perform automated relief pressure control that controls the variable solenoid relief valve 10*a* or 10*b*. In this third embodiment, each screen is displayed on the display unit 14, but no particular handling is needed on each screen, and each screen automatically changes to the next screen, as will be described subsequently herein. The remaining construction is similar to that of the above-described second embodiment. The adjustment of relief pressures in this third embodiment is performed as will be described hereinafter.

When the start switch 19 is manipulated upon adjustment of a relief pressure, the screen of the display unit 14 as depicted in FIG. 5 changes from the initial selection screen 14*a* to the mode selection screen 14*b* responsive to a display signal outputted from the controller 13, and the "Work Mode" 14*b*1 is highlighted for a predetermined time. Next, the screen of the display unit 14 changes to the adjustment target valve selection screen 14*c*, and the "Attachment 1 (ATT1)" corresponding to the desired working equipment is highlighted for a predetermined time. The screen of the display unit 14 then changes to the adjustment item selection screen 14*d*, and the "Relief Pressure Adjustment" 14*d*1 is highlighted for a predetermined time. In association with the highlighting of the "Relief Pressure Adjustment" 14*d*1, for example, a control signal is outputted from the controller 13 to the regulator 3, and the delivery rate of the variable displacement hydraulic pump 2 is controlled to become equal to a flow rate required by the hydraulic cylinder 1 for driving the desired working equipment, for example, the flow rate as designed, and pressure oil is delivered from the variable displacement hydraulic pump 2. Next, the screen of the display unit 14 changes to an adjustment execution screen 14*g*, and "Relief Valve 1" 14*g*1 corresponding to the first variable solenoid relief valve 10*a* is highlighted for a predetermined time.

In association with the operation to highlight the "Relief Valve 1" 14*g*1, a control signal is outputted from the controller 13 to the first stop valve 16*a* to switch the first stop valve 16*a* to the closed position 16*a*2. Further, a control signal is outputted from the controller 13 to the proportional solenoid valve 18*a* to switch the proportional solenoid valve 18*b*, a pilot pressure is delivered from the pilot pump 7 to the control port 4*b*1 of the directional control valve 4 via the proportional solenoid valve 18*b*, and the directional control valve 4 is switched to a left position 4*b*.

As a result, the pressure oil delivered from the variable displacement hydraulic pump 2 is fed to the main line 9*a* via the left position 4*b* of the directional control valve 4, and a pressure arise in the main line 9*a*. This pressure is detected as a circuit pressure by the pressure sensor 11, and is displayed on an adjustment bar 14*g*2 on the adjustment execution screen 14*g*. The adjustment unit of the controller 13 computes a control signal (current value) such that the circuit pressure detected by the pressure sensor 11 is brought into conformity with a graduation line located at a center of the adjustment bar 14*g*2 and indicating the pressure as designed, and the control signal is outputted from the controller 13 to the first variable solenoid relief valve 10*a*. As a consequence, the first variable solenoid relief valve 10*a* repeats increase and decrease in opening area, the circuit pressure in the main line 9*a* alternately decreases and increases, and eventually, the relief pressure control system is brought into a state that a rectangular dot, which indicates a circuit pressure detected by the pressure sensor 11, is in conformity with the graduation line at the center of the adjustment bar 14*g*2. When this state remains, for example, for a predetermined time, "End of Adjustment" 14*g*5 is highlighted for a predetermined time.

Now, a control signal is outputted from the controller 13 to the proportional solenoid valve 18*a*, for example, to switch the proportional solenoid valve 18*a* to a neutral position, in other words, to a position where the control port 4*b*1 of the directional control valve 4 is brought into communication with the reservoir 5, and the directional control valve 4 is returned to the neutral position 4*a*. A control signal is then outputted from the controller 13 to the first stop valve 16*a*, and the first stop valve 16*a* is switched to the open position 16*a*1.

After the "End of Adjustment" 14*g*5 is highlighted for a predetermined time on the adjustment execution screen 14*g*, "Relief Valve 2" 14*g*3 corresponding to the second variable solenoid relief valve 10*b* is highlighted for a predetermined time.

In association with the operation that the "Relief Valve 2" 14*g*3 is highlighted, the adjustment of the relief pressure of the second variable solenoid relief valve 10*b* is performed as in the above-described adjustment of the relief pressure of the variable solenoid relief valve 10*a*. When this adjustment of the relief pressure of the second variable solenoid relief valve 10*b* is ended, the "End of Adjustment" 14*g*5 is again highlighted for a predetermined time.

Now, a control signal is outputted from the controller 13 to the proportional solenoid valve 18*b*, for example, to switch the proportional solenoid valve 18*b* to the neutral position, and the directional control valve 4 is returned to the neutral position 4*a*. A control signal is then outputted from the controller 13 to the second stop valve 16*b*, and the second stop valve 16*b* is switched to the open position 16*b*1.

Subsequently, the screen of the display unit 14 returns to the immediately-preceding, adjustment item selection screen 14*d*, "Completed" 14*d*2 on the adjustment item selection screen 14*d* is highlighted for a predetermined time, and after an elapse of a predetermined time, the screen of the display unit 14 returns to the initial selection screen 14*a*.

As the third embodiment constructed as described above is also provided with the stop valves 16*a*, 16*b*, the control of the relief pressures of the variable solenoid relief valves 10*a*, 10*b* can be realized without actuation of the desired working equipment as in the second embodiment. As a consequence, similar advantageous effects as in the second embodiment can be obtained.

This third embodiment performs automated relief pressure control according to an instruction of a start of control of a relief pressure by the start switch 19, so that each relief pressure can be easily adjusted to the corresponding relief pressure as designed by simply manipulating the start switch 19. In the first and second embodiments, a maximum circuit pressure is allowed to occur in the main line 9*a* or 9*b* by manually manipulating the control device 6 to switch the directional control valve 4, and therefore, there is a potential problem that an error may arise depending on the manner of manipulation of the control device 6. On the other hand, this third embodiment is not affected by such an error caused by manipulation of the control device 6, and enables the setting of pressures with still higher accuracy.

In each of the above-described embodiments, the actuation pressures of the variable solenoid relief valves 10*a*, 10*b* are set at proper pressures as designed, but in view of pressure losses or the like through the main lines 9*a*, 9*b*, the actuation pressures of these variable solenoid relief valves 10*a*, 10*b* may be set at pressures higher than the pressures as designed.

Further, each of the above-described embodiment is provided with the hydraulic cylinder 1 as a hydraulic actuator for driving the working equipment. In the present invention, however, the hydraulic actuator can be a hydraulic motor that performs a rotational operation.

Furthermore, each of the above-described embodiments is provided with the two variable solenoid relief valves 10*a*, 10*b*, and corresponding to these, the two stop valves 15*a*, 15*b* or stop valves 16*a*, 16*b* are provided. When a hydraulic working machine is provided simply with a single variable solenoid relief valve, the relief pressure control system may, however, be configured to include only one stop valve corresponding to the variable solenoid relief valve.

Still furthermore, in each of the above-described embodiments, the working equipment and the hydraulic cylinder 1, in other words, the hydraulic actuator are constructed as discrete elements. Even to a working machine that constitutes a hydraulic actuator by itself, the present invention can also be applied like each embodiment described above.

LEGEND

1 Hydraulic cylinder (hydraulic actuator)
2 Variable displacement hydraulic pump
3 Regulator
4 Directional control valve
6 Control device (start instruction device)
7 Pilot pump
9*a* Main line
9*b* Main line

10*a* First variable solenoid relief valve
10*b* Second variable solenoid relief valve
11 Pressure sensor
12 Dial switch (adjustment unit)
13 Controller (adjustment unit)
14 Display unit
15*a* First stop valve
15*a*1 Open position
15*a*2 Closed position
15*b* Second stop valve
15*b*1 Open position
15*b*2 Closed position
16*a* First stop valve
16*a*1 Open position
16*a*2 Closed position
16*b* Second stop valve
16*b*1 Open position
16*b*2 Closed position
17 Control device
18*a* First proportional solenoid valve
18*b* Second proportional solenoid valve
19 Start switch (Start instruction unit)

The invention claimed is:

1. A relief pressure control system for a hydraulic working machine comprising:

working equipment, a hydraulic actuator that drives the working equipment, a variable displacement hydraulic pump that feeds pressure oil to actuate the hydraulic actuator, a directional control valve that controls a flow of pressure oil to be fed from the variable displacement hydraulic pump to the hydraulic actuator, a control device that switchingly operates the directional control valve, a pilot pump that feeds a pilot pressure to switch the directional control valve, and a variable solenoid relief valve arranged between the directional control valve and the hydraulic actuator to specify a maximum circuit pressure, wherein said relief pressure control system is provided with a pressure sensor that detects a circuit pressure, a pressure adjuster that performs an adjustment of a circuit pressure to be outputted from the pressure sensor, a controller that outputs, responsive to an adjustment signal outputted from the pressure adjuster, a control signal to control a relief pressure of the variable solenoid relief valve, a display unit that displays, responsive to display signals outputted from the controller, a relationship between the circuit pressure outputted from the pressure sensor and the pressure required by the hydraulic actuator, and a start instruction unit that instructs a start of control of the variable solenoid relief valve, a stop valve is arranged in a section of a main line, which communicates the directional control valve and the hydraulic actuator with each other, to open or close the section, said section being located between a position on the main line, where the variable solenoid relief valve is connected to the main line, and the hydraulic actuator, and the control device controls a relief pressure of the variable solenoid relief valve based on a signal outputted from the pressure adjuster such that the relief pressure of the variable solenoid relief valve becomes equal to a pressure required by the hydraulic actuator in a state where the stop valve is maintained in a closed position.

2. The relief pressure control system according to claim 1, wherein:

the stop valve comprises a manually-operated valve.

3. The relief pressure control system according to claim 1, wherein:

the stop valve comprises a solenoid valve that is actuated responsive to a control signal outputted from the controller.

4. The relief pressure control system according to claim 1, wherein:

the control device comprises a direct acting control device connected to control ports of the directional control valve.

5. A relief pressure control system for a hydraulic working machine comprising:

working equipment, a hydraulic actuator that drives the working equipment, a variable displacement hydraulic pump that feeds pressure oil to actuate the hydraulic actuator, a directional control valve that controls a flow of pressure oil to be fed from the variable displacement hydraulic pump to the hydraulic actuator, a control device that switchingly operates the directional control valve, a pilot pump that feeds a pilot pressure to switch the directional control valve, and a variable solenoid relief valve arranged between the directional control valve and the hydraulic actuator to specify a maximum circuit pressure, wherein said relief pressure control system is provided with a pressure sensor that detects a circuit pressure, a pressure adjuster that performs an adjustment of a circuit pressure to be outputted from the pressure sensor, a controller that outputs, responsive to an adjustment signal outputted from the pressure adjuster, a control signal to control a relief pressure of the variable solenoid relief valve, a display unit that displays, responsive to display signals outputted from the controller, a relationship between the circuit pressure outputted from the pressure sensor and the pressure required by the hydraulic actuator, and a start instruction unit that instructs a start of control of the variable solenoid relief valve, a stop valve is arranged in a section of a main line, which communicates the directional control valve and the hydraulic actuator with each other, to open or close the section, said section being located between a position on the main line, where the variable solenoid relief valve is connected to the main line, and the hydraulic actuator, the control device comprises an electric control device that outputs to the controller an electrical signal corresponding to an amount of manipulation of the control device, the pressure adjuster comprises an adjustment unit included in the controller, the relief pressure control system is provided with a proportional solenoid valve, which is arranged between a control port of the directional control valve and the pilot pump and is controllable by a control signal outputted from the controller responsive to a control signal outputted from the electrical control device, and the controller comprises one that, when a start of control of the relief pressure is instructed by the start instruction unit, outputs a signal to maintain in a closed position the stop valve that comprises a solenoid valve, outputs a signal to actuate the proportional solenoid valve, and makes the pressure adjuster output an adjustment signal to control the variable solenoid relief valve.

* * * * *